US007832851B2

(12) United States Patent
Murase

(10) Patent No.: US 7,832,851 B2
(45) Date of Patent: Nov. 16, 2010

(54) INK JET RECORDER

(75) Inventor: Tetsuya Murase, Chiba (JP)

(73) Assignee: Seiko I Infotech Inc. (JP)

( * ) Notice: Subject to any disclaimer, the term of this patent is extended or adjusted under 35 U.S.C. 154(b) by 464 days.

(21) Appl. No.: 11/883,412

(22) PCT Filed: Feb. 8, 2006

(86) PCT No.: PCT/JP2006/302114

§ 371 (c)(1),
(2), (4) Date: Sep. 25, 2007

(87) PCT Pub. No.: WO2006/090582

PCT Pub. Date: Aug. 31, 2006

(65) Prior Publication Data

US 2008/0100688 A1 May 1, 2008

(30) Foreign Application Priority Data

Feb. 24, 2005 (JP) ..... 2005-049551

(51) Int. Cl.
*B41J 2/01* (2006.01)

(52) U.S. Cl. ..... 347/101; 347/104

(58) Field of Classification Search ..... 347/8, 347/37, 101–105

See application file for complete search history.

(56) References Cited

U.S. PATENT DOCUMENTS 6,161,930 A 12/2000 Asano ..... 347/102
6,450,710 B1 * 9/2002 Foster et al. ..... 400/58
2002/0067401 A1 6/2002 Yraceburu et al. ..... 347/102
2002/0118266 A1 * 8/2002 Yamaguchi et al. ..... 347/104
2009/0122098 A1 * 5/2009 Shindo ..... 347/17

FOREIGN PATENT DOCUMENTS

| | | |
|---|---|---|
| GB | 2380163 | 4/2003 |
| JP | 63151849 | 10/1988 |
| JP | 08124660 | 5/1996 |
| JP | 182168 | 7/2003 |

* cited by examiner

*Primary Examiner*—Thinh H Nguyen
(74) *Attorney, Agent, or Firm*—Adams & Wilks

(57) ABSTRACT

A planar metal platen opposes an ink jet recording head for ejecting solvent-based ink and is secured through supporting members formed of polyphenylene sulfide containing glass fibers to a metal frame under a state not touching the frame directly. The platen is fixed with a heater for drying ink on a recording medium on the platen quickly. Each supporting member is secured to the frame by means of a bolt penetrating an elongated hole, and a relative position of the supporting member and the platen supported by the member, and the frame and the ink jet recording head supported by the frame, can be adjusted by shifting the position of the bolt in the elongated hole. Consequently, transmission of heat from the heater to the platen is suppressed and good recording is ensured by suppressing partial temperature difference of the platen.

15 Claims, 4 Drawing Sheets

INK JET RECORDER

CROSS-REFERENCE TO RELATED APPLICATIONS

This application is a U.S. national stage application of International Application No. PCT/JP2006/302114, filed Feb. 8, 2006, claiming a priority date of Feb. 24, 2005, and published in a non-English language.

TECHNICAL FIELD

The present invention relates to an ink jet recorder.

BACKGROUND ART

Conventionally, ink jet recorders which perform recording by ejecting ink onto a recording medium are widely used. In recent years, ink jet recorders have been used not only as home printers or office printers for preparing documents, postcards, and the like, but also used as the printers for performing recording for displays placed outdoors or the like. In this case, in order to prevent color fade-out and discoloration, solvent-based ink is used, and recording is performed on a sheet of chloroethylene, paper, or the like.

Specifically, the ink ejected from an ink jet recording head reaches the recording medium on a platen, whereby recording is performed. At this time, when time for drying ink droplets adhered to the recording medium is long, there is a problem in that the adjacent ink droplets are mixed with each other, thereby causing bleeding or a blurred image. Further, in a case where the ink drying time is long, in consideration to the drying time, a working efficiency becomes significantly low, for example, it is difficult to increase recording speed, and there is required a large space for storing the recording medium, which has undergone recording, until the ink is dried. In particular, in a case of using a relatively large recording medium such as a display placed outdoors, it is extremely troublesome to handle the recording medium after recording and before the ink is dried. Further, there is known that, in a case where the solvent-based ink is dried through air drying in a long period of time, color tone changes and a desired color does hot develop.

Patent Document 1 (JP-A-2000-108325) discloses a structure of an ink jet imaging system (plotter), which is provided with a heater in order to promote the drying of the ink. It is conceived that, also in the case where the solvent-based ink is used for recording, the structure disclosed in Patent Document 1 may be applied and heating is performed by the heater to quickly dry the ink.

As described above, in the case where the heater is used to heat the recording medium after the recording to thereby quickly dry the ink, it is thought to be the most effective that the heater is directly mounted to the platen for supporting the recording medium at a position facing the ink jet recording head. In particular, the platen formed of metal has high heat conductivity and easily transfer the heat of the heater to the recording medium. Therefore, if the heater is mounted to the metal platen, drying speed of the ink increases, which contributes to increase of the recording speed.

In the case of the large recording medium such as the display placed outdoors, the metal platen for supporting the recording medium is also large. In a case of a planar platen, with increase in size and weight thereof, it becomes difficult to firmly support the platen only by supporting at end portions thereof. It is desirable to support the planar platen using a substantially entire surface thereof, but it is not practical from the viewpoints of costs and a structure. Therefore, it is common to support the platen at a plurality of positions by using a plurality of support members aligned in a longitudinal direction of the platen.

In order to achieve recording with high accuracy, it is required for a gap between a nozzle of the ink jet recording head and the recording medium to be precisely and uniformly maintained at all times. To achieve this, positional accuracy and dimensional accuracy of the platen for supporting the recording medium so as to face the ink jet recording head are important. In general, the platen is formed of a metal such as aluminum or iron, and is finished by extruding or shaving with high dimensional accuracy (for example, with a tolerance of about 20 to 30 μm). As a matter of course, high dimensional accuracy is required also for the support members for supporting the platen. Hence, the support members are formed of a metal such as aluminum or iron as well as the platen, and are finished by shaving with high dimensional accuracy. As described above, in the structure in which the plurality of metal support members are used to support the metal platen, high dimensional accuracy is obtained.

However, since the metal such as aluminum or iron has high heat conductivity, a part of the heat transferred from the heater to the platen escapes to a frame or the like through the support members. As described above, the platen is, supported at the plurality of positions by the support members aligned in the longitudinal direction of the platen. Therefore, in the thus constructed platen, an amount of the escape of heat transferred from the heater is small in positions away from the support members, thereby being capable of promoting the drying of the ink. Besides, an amount of the escape of heat transferred from the heater is large in the vicinity of the support members, thereby causing drying of the ink to be relatively slow. Due to the escape of the heat through the support members as described above, there is caused partial temperature difference in the platen. Due to the partial temperature difference caused in the platen, there generate a part where the ink is dried fast and a part where the ink is dried slowly on the recording medium. This results indifferences in dot diameter (size) or shape owing to, for example, differences in how the ink spreads, or constitutes a factor for color shading or reduction in recording accuracy.

It is therefore an object of the present invention to provide an ink jet recorder in which the escape of the heat transferred from the heater to the platen may be reduced and the partial temperature difference caused in the platen is suppressed, thereby being capable of performing favorable recording.

DISCLOSURE OF THE INVENTION

An ink jet recorder according to the present invention is characterized by including: an ink jet recording head for ejecting ink onto a recording medium; a planar metal platen, which is positioned in a position facing the ink jet recording head, for supporting the recording medium; a heater mounted to the platen; and support members, formed of a synthetic resin, for supporting the platen. The support members are positioned between the platen and a metal frame to fix the platen to the frame in a state where the platen not coming into direct contact with the frame.

With this structure, heat transferred from the heater to the platen hardly escapes through the support members, so temperature of the entire platen can be maintained substantially uniformly. Accordingly, the ink adhered to the recording medium on the platen can be quickly and evenly dried, thereby making it possible to perform favorable recording. Further, the support members are molded of a synthetic resin, so, as compared to a case where the support members are formed by metal working, the support members can be manufactured at low cost.

The support members may allow adjustment of a relative position of the platen with respect to the frame. In this case, even in a case where flatness of the platen itself and dimensional accuracy of the support members are low to some extent, the positional accuracy of the platen and the frame can be increased, thereby making it possible to maintain the gap between the platen and the ink jet recording head and the relative positions thereof with high accuracy. Thus, manufacture thereof can be easily carried out while maintaining the relative positional accuracy favorable.

For example, each of the support members has an elongated hole and is fixed to the frame by a bolt or a pin passing through the elongated hole, and the relative position of the platen with respect to the frame can be adjusted by shifting a position the bolt or the pin in the elongated hole.

In a case where the support members are formed of a synthetic resin into which glass fiber is mixed, a sufficient strength for supporting the platen can easily be obtained.

In a case where the synthetic resin as a material of the support members is polyphenylene sulfide, the support members can be molded with high accuracy and are excellent in heat resistance and resistance to solvent, so the polyphenylene sulfide is preferable. Note that, the support members can be formed of other synthetic resins.

The structure as described above is particularly effective in a case where the ink jet recording head ejects solvent-based ink to the recording medium to perform recording.

DETAILED DESCRIPTION OF THE INVENTION

Hereinafter, embodiments of the present invention will be described with reference to the drawings.

Figure 1:
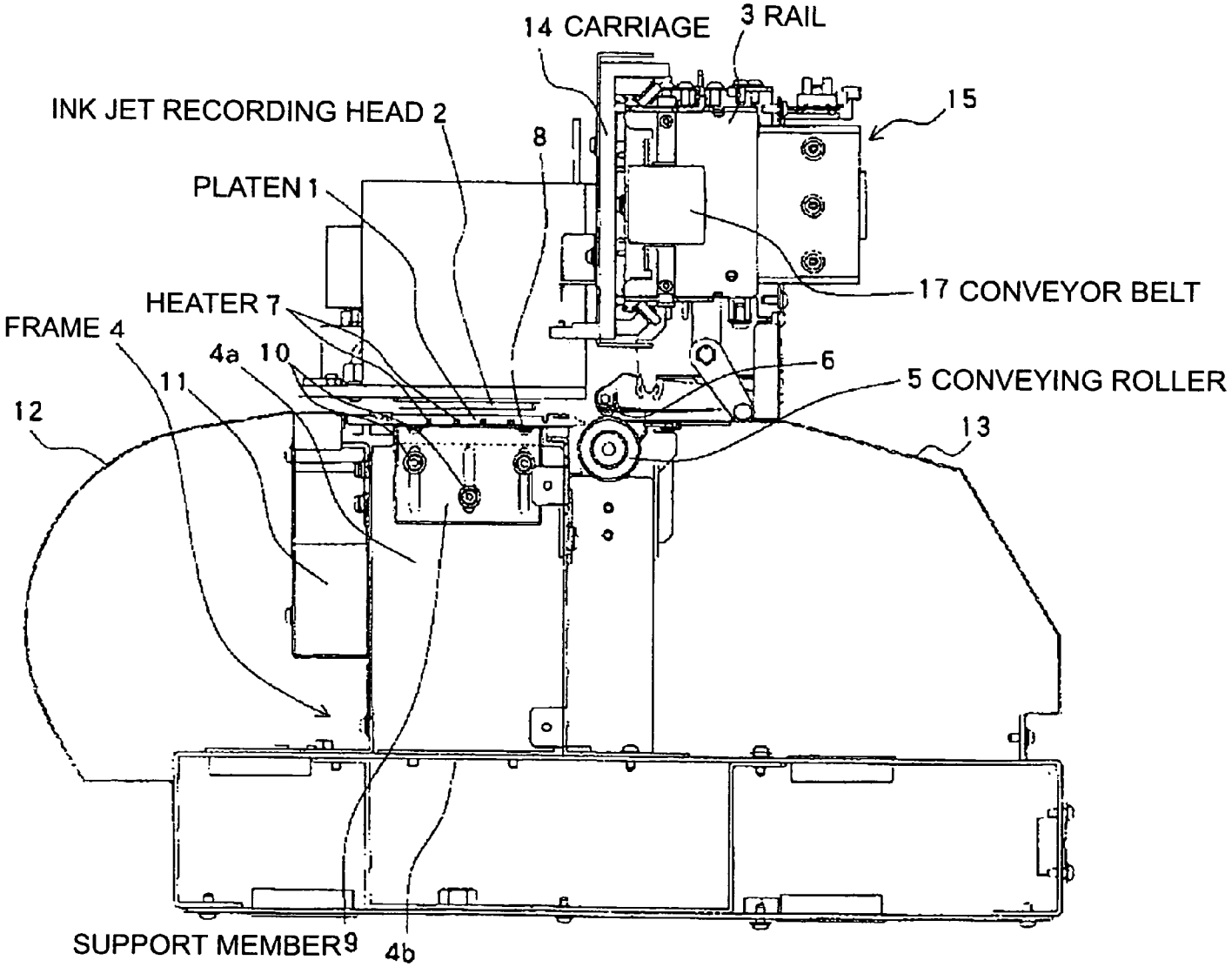
FIG. 1 is a side view of an ink jet recorder according to a first embodiment of the present invention.
Figure 2:
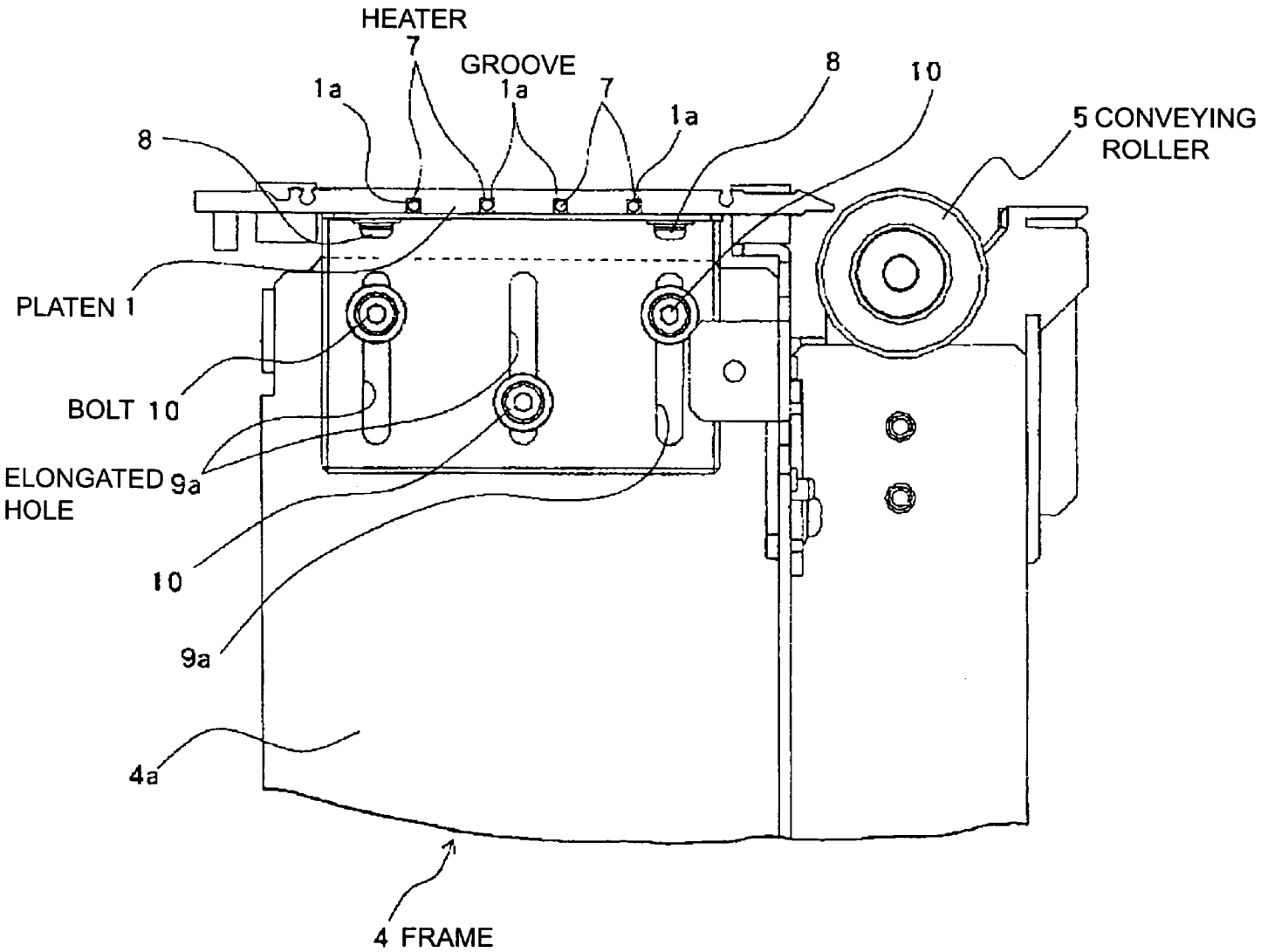
FIG. 2 is an enlarged view of a main portion of the ink jet recorder shown in FIG. 1.
Figure 3:
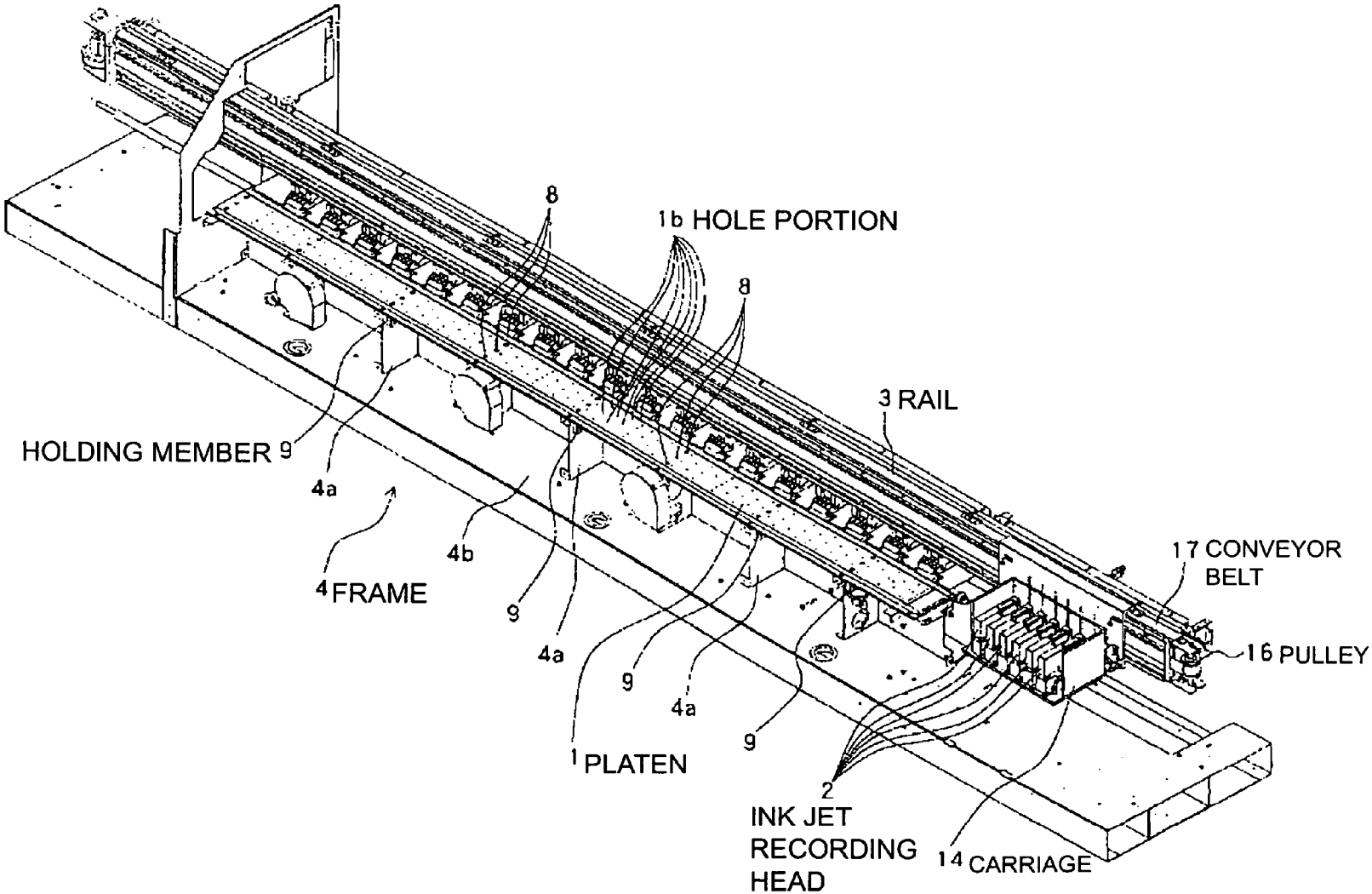
FIG. 3 is a perspective view of the vicinity of a platen of the ink jet recorder shown in FIG. 1.

FIG. 1 shows an overall structure of an ink jet recorder according to a first embodiment of the present invention. FIG. 2 is an enlarged view of a support structure of a platen 1 thereof. FIG. 3 is a perspective view of the platen 1 and ink jet recording heads 2. The ink jet recorder of this embodiment has a structure in which, while a thin sheet-like recording medium (not shown) is conveyed by being passed on the planar platen 1 and the ink jet recording heads 2 at a position facing the platen 1 moves along a rail 3, ink is ejected onto the recording medium, thereby performing recording.

A description will be formed of a basic structure of the ink jet recorder. A conveying roller 5 for conveying the recording medium is mounted to a frame 4 formed of metal. The conveying roller 5 being driven by drive means (not shown). By the conveying roller 5, an opposed roller 6, and the like, the recording medium can be conveyed from the right to left of FIG. 1. The platen 1 for supporting the recording medium is provided in midway of a conveying path of the recording medium.

The platen 1 has an elongated planer shape extending in a direction perpendicular to a conveying direction of the recording medium, that is, a width direction of the recording medium. As shown in FIG. 2, in a rear surface (lower side in FIG. 2) of the platen 1, there are formed a plurality of grooves 1*a*, and a heater 7 for heating is mounted in each of the grooves 1*a*. The platen 1 is fixed to the support members 9 by screws 8 at a plurality of positions aligned in the longitudinal direction of the platen 1. Each of the support members 9 is fixed to an upright portion 4*a* of the frame 4 by bolts 10. Accordingly, the platen 1 is supported through the plurality of support members 9 while not coming into direct contact with the frame 4. The platen 1 and the support members 9 will be described later in detail.

On a lower side of the platen 1, there are provided a space surrounded by the upright portions 4*a* and flat plate portion 4*b* such that the heat from the heater 7 is not directly transferred to a user or other members. In the space, there is provided a fan 11. High-temperature air sucked by the fan 11 is discharged to an outside. When the fan 11 operates, the recording medium is sucked through hole portions 1*b* (see FIG. 3) of the platen 1 to be adhered onto the platen 1. FIG. 1 only shows a casing of the fan 11. On a downstream side (left side in FIG. 1) and on an upstream side (right side in FIG. 1) of the platen 1, there are provided curved guide plates 12 and 13 for supporting the recording medium, respectively. Thus, the recording medium is smoothly conveyed by the conveying roller 5 and the like from a position on the guide plate 13 on the upstream side through a position on the platen 1 to a position on the guide plate 12 on the downstream side.

As shown in FIG. 3, in this embodiment, the plurality of inkjet recording heads 2 are installed in a carriage 14 and are positioned above the platen 1. The carriage 14 is supported by a support mechanism 15, which is not described in detail, and can be moved by a pulley 16 and a conveyor belt 17 driven by a drive device (not shown) along the rail 3 in a direction parallel to the platen 1, that is, a direction perpendicular to the conveying direction of the recording medium. The ink jet recording heads 2 of this embodiment can eject the solvent-based ink of different colors, respectively. A portion where the inkjet recording heads 2 and the platen 1 are positioned is a so-called recording portion of the ink jet recorder.

In the ink jet recorder having structured as described above, when a recording medium is supplied onto the guide plate 13 on the upstream side, and an edge of the recording medium is conveyed to a recording start position on the platen 1, the conveyance of the recording medium is stopped once at that point. The fan 11 operates to suck the recording medium onto the platen 1 through the hole portions 1*b*. While the carriage 14 is moved by the pulley 16 and the conveyor belt 17 in a direction perpendicular to the conveying direction of the recording medium, the ink jet recording heads 2 eject ink onto the recording medium on the platen 1 at proper timings, thereby performing recording in a predetermined width. A detailed description is not given, however, each of the ink jet recording heads 2 is normally provided with a plurality of nozzles and at a timing corresponding to the movement of the carriage, one of the nozzles is sequentially selected and the ink is ejected from the selected nozzle, thereby performing desired recording in the predetermined width. When the movement of the carriage 14 and the recording by the ink jet recording heads 2 in the predetermined width are completed, the conveying roller 5 rotates to convey the recording medium by a predetermined pitch (predetermined width), and then stops. Here, while the carriage 14 moves, the ink jet recording heads 2 eject ink at proper timings onto proper positions of the recording medium, thereby performing the recording in the predetermined width. In this way, intermittent conveyance of the recording medium by the predetermined pitch, and the movement of the carriage 14 and the ink ejection by the ink jet recording heads 2 are alternately repeated, thereby recording the entire recording medium. The recording medium is successively fed out, from a portion thereof on which recording has been completed, onto the guide plate 12 on the downstream side.

The recording is performed after the heaters 7 mounted to the rear surface of the platen 1 are driven, heat is generated, and the platen 1 reaches a predetermined temperature. Accordingly, the ink ejected onto the recording medium on the platen 1 is heated, thereby promoting the drying thereof. Until the solvent-based ink is dried, there is a possibility of the bleeding and effacement of color. Therefore, the ink cannot be brought into contact with other members, and next recording is performed after the ink is dried to a certain degree and the color (ink) settles down. This conventionally constitutes a factor for decreasing conveying speed of the recording medium. However, in the present invention, the ink is heated by the heat from the heater 7 to quickly be dried, the conveying speed of the recording medium can be increased. Further, a period of time for leaving the recording medium to stand in order to dry the ink after the recording becomes unnecessary. Therefore, the space for storing the recording medium without stacking the recording medium becomes unnecessary. The high-temperature air is sucked by the fan 11 to be discharged to the outside.

Next, a structure of the platen 1 and the support members 9, which is a main characteristic point of the present invention, will be described. The platen 1 of this embodiment is formed of aluminum and is formed by extruding with high accuracy (with a tolerance of about 20 to 30 μm). In particular, accuracy of a thickness thereof is higher (about ±5). The frame 4 is also formed of a sheet metal (iron). On the other hand, the support members 9 of this embodiment are prepared by injection molding a molding material obtained by mixing 10 to 20% of glass fiber into polyphenylene sulfide (PPS). Accordingly, the platen 1 formed of aluminum having high heat conductivity and the frame 4 formed of iron do not come into direct contact with each other, and the support members 9 formed of a synthetic resin having low heat conductivity are interposed therebetween. Note that, in this embodiment, a base portion including the flat plate portion 4*b* and the upright portions 4*a* is collectively referred to as the "frame 4". FIG. 1 is a view in which a position of a section is partially changed such that a fixing portion between the support member 9 and the upright portion 4*a* of the frame 4 can easily be seen.

If, as with the platen 1 and the frame 4, the support members 9 are also formed of metal such as aluminum or iron having high heat conductivity, the heat transferred from the heater 7 to the platen 1 is transferred and escapes from the support members 9 to the frame 4. Accordingly, on the platen 1, there generate a part increased in temperature and a part decreased in temperature. For example, a temperature difference in the platen 1 becomes about 10°, so, as described above, there is caused a difference between dot diameters of the ink on the recording medium positioned on the platen 1, and this develops as color shading and recording failure. However, in the present invention, the support members 9 are formed of a synthetic resin having low heat conductivity, so the heat of the platen 1 hardly escapes to the frame 4, and a uniform temperature state (for example, the temperature difference is 5° C. or less) of the platen 1 is maintained. Accordingly, the ink adhered to the recording medium on the platen 1 can be dried at substantially the same speed and the dot diameters thereof do not differ from each other. Therefore, favorable recording without color shading can be performed.

Note that, the support members 9 of this embodiment are formed of a material containing as a main component thereof polyphenylene sulfide, so the support members 9 can be formed with relatively high accuracy. Therefore, a tolerance of 20 to 30 pm that is substantially the same as that of a conventional member formed of aluminum can be achieved. Further, polyphenylene sulfide is excellent in heat resistance and resistance to solvent, so the polyphenylene sulfide is not deformed due to an effect of the heat from the heater 7, or degraded or melted by coming into contact with the solvent-based ink. Further, 10 to 20% of the glass fiber is mixed into the polyphenylene sulfide, so a sufficient strength for supporting the platen 1 is obtained. Note that, the synthetic resin used as the material of the support members 9 is not limited to polyphenylene sulfide, other various synthetic resins may be used. Further, the glass fiber is not necessarily mixed therein, and a reinforcement material other than the glass fiber may be mixed therein. A mixing ratio of the glass fiber or other reinforcement materials is not particularly limited. The platen 1 and the frame 4 are not necessarily formed of aluminum or iron, those may be formed of other materials. Note that, the platen 1 is preferably formed of metal which has high heat conductivity and enables formation with high accuracy.

Each of the support members 9 of this embodiment is provided with three elongated holes 9*a*, and is fixed to the upright portion 4*a* of the frame 4 by the bolts 10 passing through the elongated holes 9*a*. By changing positions of the bolts 10 in a range of the elongated holes 9*a*, a relative positional relationship between the frame 4 and the platen 1 fixed to the support members 9 by the screws 8 can be adjusted. As a result, accuracy of the gap between the recording medium placed on the platen 1 and the ink jet recording heads 2, which are mounted to the frame 4 through the support mechanism 15 and the carriage 14 with high accuracy, and accuracy of relative positions of those can be increased. If the dimensional accuracy of each of the support members 9 itself is a little low, by adjusting the positions of the bolts 10 in the elongated holes 9*a*, relative positional accuracy can be increased. As a result, favorable recording can be performed. For a position adjusting method, a structure is not limited to that using the elongated holes 9*a* and the bolts 10, but other various structures may be adopted. For example, there may be conceived a structure in which elongated holes are provided to the upright portions 4*a* of the frame 4 instead of the support members 9 and the support members 9, and by bolts passing therethrough, the upright portions 4*a* are fixed to each other, a structure in which a plurality of holes are provided to the upright portions 4*a* of the frame 4, and by passing the bolts 10 through the holes appropriately selected among the plurality of holes, thereby mounting the supporting members 9 to the frame 4, and the like.

Figure 4:
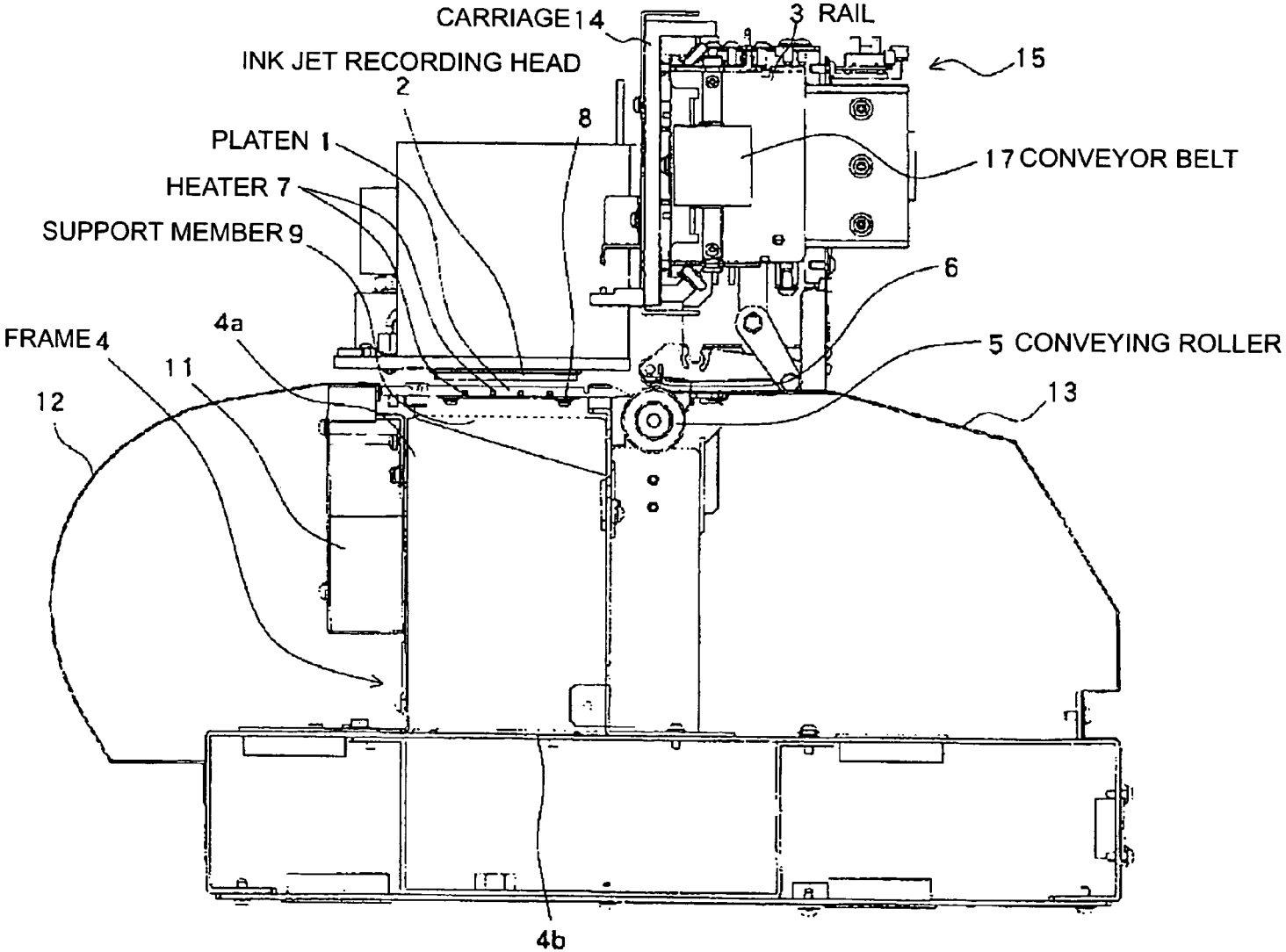
FIG. 4 is a side view of an ink jet recorder according to a second embodiment of the present invention.

Note that, in the structure shown in FIG. 4, the support member 9 is fixed to the upright portion 4*a* of the frame 4 by fixing screws or the like (not shown) instead of using the elongated hole 9*a* and the bolts 10 so as not to be movable. With this structure, position adjustment cannot be performed. However, in a case where the frame 4 is formed with high accuracy (high flatness) and, as described above, the support members 9 are formed of polyphenylene sulfide or the like with high accuracy, the bolts 10 are not accidentally shifted in position, thereby making it possible to support the platen 1 with high accuracy. Other structures are the same as that of the embodiment shown in FIGS. 1 to 3, so the same components are denoted by the same reference numerals and the description thereof will be omitted.

INDUSTRIAL APPLICABILITY

According to the present invention, by suppressing the escape of the heat transferred from the heater to the platen and suppressing partial temperature difference of the platen, the ink adhered to the recording medium on the platen is quickly and evenly dried, thereby making it possible to perform favorable recording.

The invention claimed is:

1. An ink jet recorder, comprising:

an ink jet recording head for ejecting ink onto a recording medium;

a planar metal platen, which is positioned in a position facing the ink jet recording head, for supporting the recording medium;

a heater mounted to the platen; and support members positioned between the platen and a metal frame to fix the platen to the frame in a state where the platen does not come into direct contact with the frame, each of the support members having an elongated hole and being fixed to the frame by a bolt or a pin passing through the elongated hole so that the relative position of the platen with respect to the frame can be adjusted by shifting a position of the bolt or the pin in the elongated hole, the support members being formed of a synthetic resin having glass fibers mixed therein.

2. An ink jet recorder according to claim 1, wherein the synthetic resin comprises polyphenylene sulfide.

3. An ink jet recorder according to claim 2, wherein the ink jet recording head ejects solvent-based ink onto the recording medium to perform recording.

4. An ink jet recorder according to claim 1, wherein the ink jet recording head ejects solvent-based ink onto the recording medium to perform recording.

5. An ink jet recorder, comprising:

an ink jet recording head for ejecting ink onto a recording medium;

a planar metal platen, which is positioned in a position facing the ink jet recording head, for supporting the recording medium;

a heater mounted to the platen; and support members, formed of a synthetic resin having glass fibers mixed therein, for supporting the platen.

6. An ink jet recorder according to claim 5, wherein the support members are positioned between the platen and a metal frame to fix the platen to the frame in a state where the platen does not come into direct contact with the frame.

7. An ink jet recorder according to claim 6, wherein the support members allow adjustment of a relative position of the platen with respect to the frame.

8. An ink jet recorder, comprising:

an ink jet recording head for ejecting ink onto a recording medium;

a planar metal platen, which is positioned in a position facing the ink jet recording head, for supporting the recording medium;

a heater mounted to the platen; and support members, formed of a synthetic resin comprised of a polyphenylene sulfide, for supporting the platen.

9. An ink jet recorder according to claim 8, wherein the support members are positioned between the platen and a metal frame to fix the platen to the frame in a state where the platen does not come into direct contact with the frame.

10. An ink jet recorder according to claim 9, wherein the support members allow adjustment of a relative position of the platen with respect to the frame.

11. An ink jet recorder, comprising:

an ink jet recording head for ejecting solvent-based ink onto a recording medium;

a planar metal platen, which is positioned in a position facing the ink jet recording head, for supporting the recording medium;

a heater mounted to the platen; and support members, formed of a synthetic resin, for supporting the platen.

12. An ink jet recorder according to claim 11, wherein the support members are positioned between the platen and a metal frame to fix the platen to the frame in a state where the platen does not come into direct contact with the frame.

13. An ink jet recorder according to claim 12, wherein the support members allow adjustment of a relative position of the platen with respect to the frame.

14. An ink jet recorder according to claim 11, wherein the synthetic resin comprises polyphenylene sulfide.

15. An ink jet recorder according to claim 11;

wherein the support members contain glass fibers mixed in the synthetic resin.

* * * * *